US005606155A

United States Patent [19]

Garcia

[11] Patent Number: 5,606,155

[45] Date of Patent: Feb. 25, 1997

[54] ROTARY SWITCH

[76] Inventor: Ricardo L. Garcia, 11484 Coriender Ave., Fountain Valley, Calif. 92708

[21] Appl. No.: 384,157

[22] Filed: Feb. 6, 1995

[51] Int. Cl.[6] ..... H01H 19/54

[52] U.S. Cl. ..... 200/11 R; 200/11 K

[58] Field of Search ..... 200/11 R–11 TW, 200/43.08, 560–572, 293–307, 336, 11 G, 11 J, 11 K

[56] References Cited

U.S. PATENT DOCUMENTS

| | | | |
|---|---|---|---|
| 3,311,718 | 3/1967 | Allison et al. | 200/11 K |
| 3,803,370 | 4/1974 | Garcia | 200/11 J |
| 4,490,588 | 12/1984 | Guenther et al. | 200/11 R |
| 4,623,763 | 11/1986 | Krause | 200/11 K |
| 4,639,562 | 1/1987 | Fredrickson | 200/43.08 |
| 4,771,149 | 9/1988 | Armstrong et al. | 200/336 |
| 4,780,578 | 10/1988 | Heskel | 200/11 R |
| 4,910,364 | 3/1990 | Garcia | 200/11 A |
| 5,326,944 | 7/1994 | Garcia | 200/11 R |

*Primary Examiner*—J. R. Scott
*Attorney, Agent, or Firm*—Harold L. Jackson

[57] ABSTRACT

A rotary switch is disclosed which has a ferrule, rotor and stator assembly housed within a plastic cylindrically shaped housing. The ends of the housing are uniquely folded to hold the ferrule and stator in end positions within the housing on edges located on the interior wall the housing. The rotor has a shaft which is rotatably mounted in the ferrule for relative movement over the stator. Stationary contacts are provided on the stator, while moveable ball contacts carried by the rotor seat on the stator for displacement relative to the stationary contacts upon turning of the rotor via the shaft. A detent mechanism cooperates with the interior wall of the housing to establish detent positions corresponding with predetermined electrical coupling of the stator contacts by the ball contacts.

This housing arrangement provides a relatively simple and inexpensive rotary switch of relatively small sized which has a high switch capacity.

14 Claims, 3 Drawing Sheets

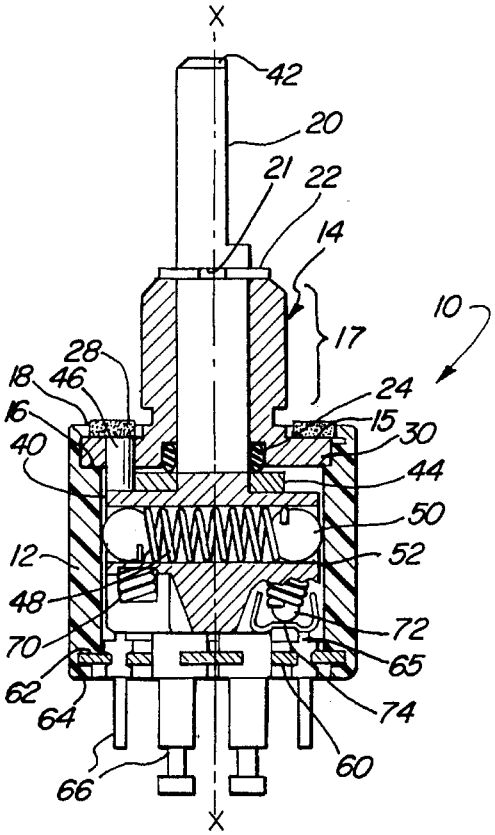
FIG. 1
FIG. 2
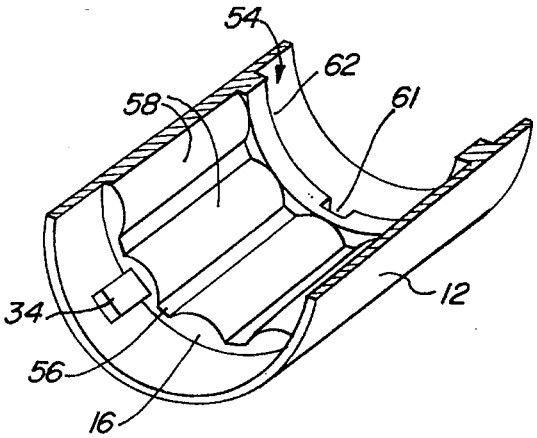
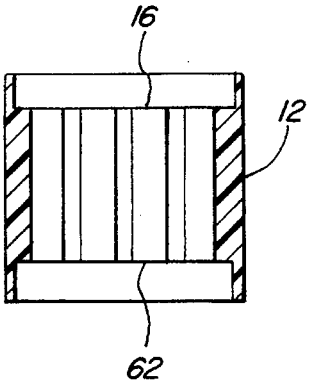
FIG. 3
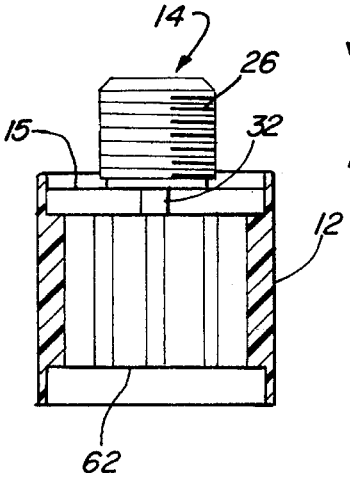
FIG. 4
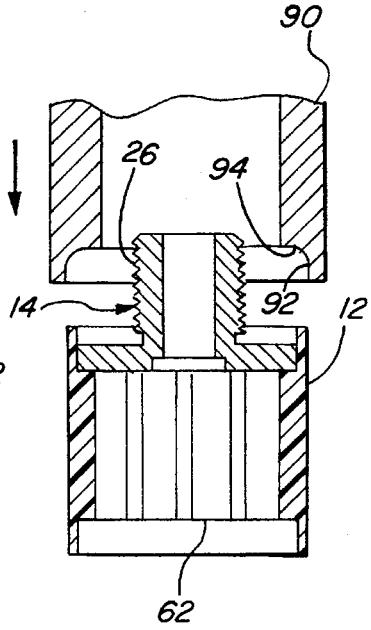
FIG. 5
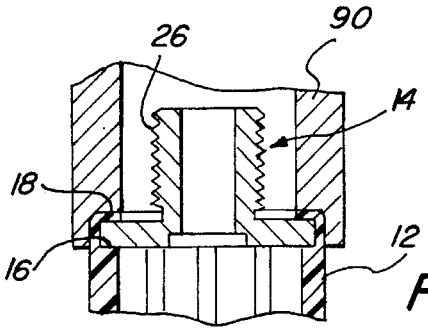
FIG. 6
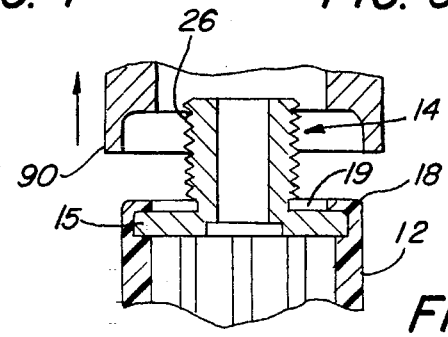
FIG. 7

ROTARY SWITCH

BACKGROUND OF THE INVENTION

1. Field of the Invention

The invention relates generally to switches and more particularly to electromechanical multiposition rotary switches and to a method of manufacturing rotary switches.

2. Description of Related Art

As compared to many other types of electrical switching mechanisms, the electromechanical rotary switch provides a desirable means to control large numbers of circuits over a wide range of currents, voltages and power requirements. Rotary style switches provide electrical control for instrumentation, medical equipment, aircraft, computers, industrial controls, communication, ordnance, as well as ground support equipment.

Conventional rotary switches include a cylindrically shaped metal housing with an integral ferrule fabricated into one end of the housing. A rotor mounted within the metal housing is coupled to a shaft which extends through the ferrule such that the shaft can be manipulated and rotated by the fingers of an operator's hand. The metal housing also contains a stator mounted at the other end thereof adjacent to the rotor. The stator typically has an arrangement of stationary terminals and common contacts thereon. An arrangement of contact springs and metallic balls and brush contacts located on the rotor slidably and selectively engage certain of the terminals or contacts on the stator. More specifically, metal contacts associated with terminals or common contacts located on the stator are selectively electrically coupled to various other terminals or common contacts on the stator by turning the shaft and the rotor therewith.

Disadvantageously, the metal housing arrangement described above is labor intensive to fabricate requiring a number of intricate machining operations to complete, which is especially problematic for smaller switch sizes. Additionally, where the metal housing is used to engage the rotor detent mechanism, wear of the internal surface of the metal housing over time will produce tiny metal fragments. Such fragments may become lodged on the surface of the stator and cause undesirable shorting between the electrical contacts thereon. A plastic sleeve inside of the metal housing may be used for indexing purposes to substantially reduce the shorting problem. However, such sleeve increases the overall diameter of the switch and adds to the manufacturing cost . A rotary switch without these aforementioned problems and other undesirable features would provide an advancement in the art.

SUMMARY OF THE INVENTION

It is therefore an object of the invention to provide a rotary switch with an improved housing arrangement that is relatively easy to manufacture and assemble.

It is another object of the invention to provide a rotary switch that is of simple construction yet reliable with high switching capacity.

It is still a further object of the invention to provide a rotary switch that is of relatively low cost as compared to conventional metal housing rotary switches.

It is yet another object of this invention to provide an improved method for assembling a rotary switch.

It is an advantage of the invention that the improved , housing arrangement provides good mechanical life of the rotary switch in a relatively small size.

It is another advantage/objective of the invention to form the housing out of a plastic material to thereby eliminate tiny metal fragments which often result with the use of a metal housing, therein rendering the switch more reliable in low voltage and low current applications.

A rotary switch according to the present invention includes a rotor and shaft rotatably mounted in a generally cylindrically shaped housing made of plastic-like material. A ferrule is mounted on a seating structure in one end of the housing and the edges of the housing are formed over the ferrule to hold it within the housing and to form an annular groove which holds a panel seal in place. A shaft carrying a rotor disc, is rotatably mounted in the housing with the shaft extending through the ferrule. A stator is mounted at the other end of the housing on another seating structure and the edges of the housing are formed over the stator to hold the stator within the housing. The rotor rotates over the stator and a cooperate contact arrangement mounted thereon selectively electrically couples contacts on the stator. A detent mechanism arrangement may also be employed between the rotor and housing to provide a number of switch positions as desired.

BRIEF DESCRIPTION OF THE DRAWINGS

FIG. 1 is a cross-sectional view of a switch assembly in accordance with the principles of the invention;

FIG. 2 is a partially broken away perspective view of the housing of FIG. 1;

FIGS. 3–9 illustrate various steps in a preferred method for fabricating the switch assembly of FIG. 1;

DESCRIPTION OF PREFERRED EMBODIMENTS

Figure 8:
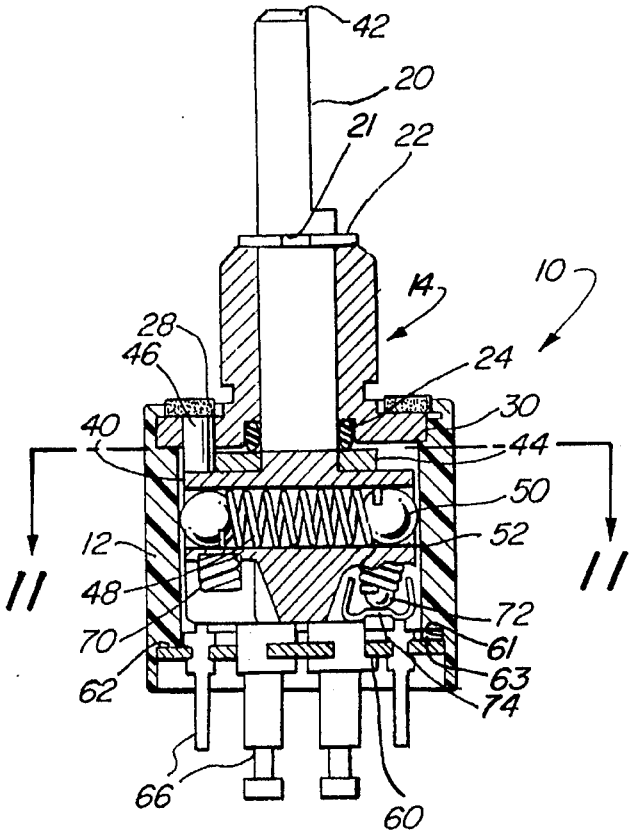

Referring now to the drawings, wherein like or similar parts are designated by the same numerals throughout the various figures, a rotary switch 10 aligned along a longitudinal axis x-x is illustrated in FIGS. 1–2 and 10–11, having a housing 12 which is generally cylindrically shaped and preferably made of a plastic material such as a reinforced thermoplastic or other nonmetallic material. For example, the housing is preferably made of reinforced thermoplastic (such as nylon)with a V-O (self extinguishing) rating. An inner annular edge or shoulder 16 protrudes from the interior wall of the housing at one end thereof and circumscribes the interior wall to form a step or seat structure as shown. Ferrule 14 is located at one end of housing 12. In this example, ferrule 14 has a disc-shaped base portion 15 and an axially aligned threaded cylindrical portion 17 protruding from the base portion. Ferrule 14 sits on the inner annular shoulder 16 and is held against the shoulder by housing top flange 18 which overlaps the ferrule base portion 15, extending radially inwardly thereover.

Figure 10:
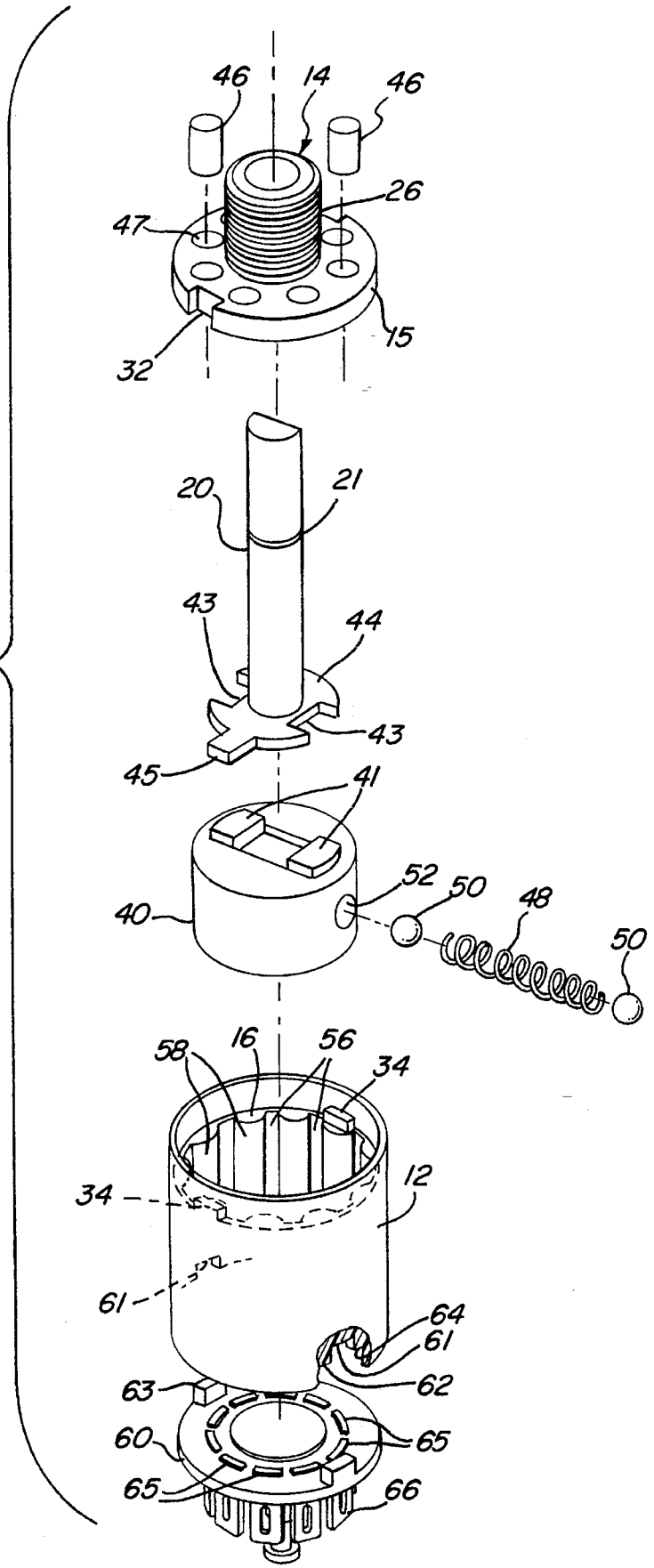
FIG. 10 is an exploded view of the major components of the switch assembly of FIG. 1.

The external threads 26 (FIG. 10) on ferrule 14 along with a panel nut and washer (not shown) provide a means to affix the rotary switch 10 to a instrument panel or other desired location. The flange 18 forms an annular groove 19 which confines a panel seal 28 to the groove area and prevents distortion of the panel when compressed by the panel nut to secure the switch in place. The panel seal 28 seals the interior area of the switch from possible external contaminants such as moisture. In order to hold or lock the ferrule 14 and housing 12 in a fixed relationship so the ferrule 14 does not rotate with respect to the housing 12, ferrule 14 and interior wall of housing 12 have a cooperative key arrangement 32/34 (FIGS. 2 and 10), provided by complementary interlocking surfaces. More specifically as illustrated in FIGS. 2 and 10, one or more notches 32 may be provided on the lateral edge of the ferrule base portion 15 and the interior wall of the housing 12 may have one or more tabs 34 thereon of similar size and shape to the notches 32. The tabs engage the notches and seat together when the base portion 15 is placed on the inner annular shoulder 16. Also see FIG. 4.

Shaft 20 is rotatably mounted in ferrule 14 and may be made of steel or nickel plated brass. A C-clip 22, positioned in an annular groove 21 (FIG. 10) holds the shaft 20 axially in position with respect to the ferrule. At the other end of the ferrule a rubber O-ring 24 surrounding the shaft 20 and located in an annular recess in the ferrule seals the interior area of the housing from possible external contamination. Shaft 20 may have a typical "D" cross-section with a flat side wall. In use, a turning knob (not shown) is slipped over the end of the shaft and a set screw in the knob is tightened against the flat side wall to hold the knob securely to the shaft. The rotary switch can then be easily manipulated by the finger of an operator's hand.

The rotor is preferably cylindrical and is comprised of a nonconductive material such as a printed circuit board laminate. A stop plate 44 with integral tab 45 is mounted on the shaft 20 and seated on top of the rotor 40. A cooperative key arrangement provided by interlocking tabs 41 and notches 43, on the rotor 40 and stop plate 44, respectively, locks the shaft and rotor together, as shown more specifically in FIGS. 10 and 11. The shaft and rotor thus rotate together along longitudinal axis x-x. The tab 45 on plate 44 cooperates with stop pins 46, inserted in holes in the ferrule 14, to prevent rotation of the shaft 20 and rotor 40 past the first or last detent positions as shown with more particularity in FIGS. 10 and 11. The shaft 20, rotor 40 and stop plate 44 typically are put together in the form of a subassembly, which subassembly is mounted within the housing 12 with the shaft inserted into the ferrule 14.

Stator 60 is located adjacent to the bottom of the rotor 40 and at the other end of housing 12. Stator 60 seats on another inner annular edge or shoulder 62 at the other end of the housing. The inwardly projecting shoulder 62 forms a step or seating structure and the stator is held against this edge by bottom annular flange 64 which extends radially inwardly over the stator 60. The stator 60 is a thin disc-shaped block molded in one piece from an insulating plastic material. Stator 60 has a front surface with a plurality of metallic contact portions 65 formed thereon. These contact portions 65 are arranged in circumferentially spaced relationship. Each contact portion 65 has an associated connecting metal terminal 66 molded in the stator block with the wire connecting portion extending rearwardly out the back surface of the stator, such wire connecting portions are typically provided with a wire connecting slot for receiving an electrical insulated wire (not shown). The stator 60 and housing 12 may also have a cooperative key arrangement comprising tabs 63 on the stator which seat in similarly sized and shaped notches 61 (FIG. 2) on the inner wall of the housing 12.

The detent or switch positions of the rotary switch 10 may be facilitated by an arrangement of metallic detent balls backed by a spring located in the rotor. The metallic detent balls cooperatively engage laterally spaced recesses in the interior wall of the housing as will be explained. More specifically, in this particular embodiment, to provide the detent or switch positions, spring 48 and detent balls 50 are located in hole 52 (See FIG. 10). This hole is traversely disposed through rotor 40. The interior wall 54 of housing 12 has a plurality of interior laterally spaced axially extending grooves 56 and ridges 58. These grooves form detent ball receiving positions. The balls 50 seat on the interior wall surface between the ridges 58 in the grooves 56 as shown in FIG. 10. Shaft 20 may be rotated such that detent balls 50 digitally rotate along the interior wall of the housing passing over ridges from one groove (detent position) to another groove. Upon achieving the desired shaft position the spring 48 holds the detent balls 50 in their respective opposed grooves 56 and consequently the rotor 40 is held in fixed position in relation to the stator 60.

To achieve electrical contact between selected common and terminal contacts, stator 60, detent balls 72 and finger brush contacts 74 are located in recesses which extend into the bottom of the rotor 40. The brush contacts 74 are held, in resilient engagement via springs 70, against the inner surface of the stator 60. The stator inner top surface has contact portions 65 for the various common and terminal contacts 66 which are engaged by the brush contacts 74. The brush contacts 74 electrically connect certain common and terminal contacts 65 upon rotation of the switch shaft into its various detent positions. The rotor 40 selectively locates the brush contacts 74 on pairs of contact pads associated with certain common and terminal contacts as is illustrated in FIG. 1

The rotary switch 10 may be made by a preferred process as illustrated by FIGS. 3–9. FIG. 3 shows a cross section of the switch housing 12 showing the upper inner annular edge or shoulder 16 and the lower annular edge or shoulder 62. Ferrule 14 is preheated to an elevated temperature in the range of about 180 to 240 degrees centigrade (° C.) the preferred temperature range being about 200° to 220° C. and most preferably about 210° C. After heating, the ferrule 14 is inserted into the housing 12 with the base portion thereof sitting on inner annular edge 16 of housing 12. The end portion of housing 12 extends above the base portion 15 of the ferrule 14, as shown in FIG. 4.

The housing 12 with the preheated ferrule 14 positioned therein is located under a mandrel 90. The mandrel 90 is cylindrically shaped and the end thereof has an inwardly extending shoulder 92 which flattens into an annular ring 94 as shown in FIG. 5. The mandrel 90 is heated to an elevated temperature in the same range as the ferrule. The end portion of housing 12 is then pressed into the mandrel as shown in FIG. 6 such that the inwardly extending shoulder of the mandrel rolls the end portion of housing toward the center and consequently over the upper surface of ferrule base portion forming annular top flange 18 overlapping the ferrule base portion 15. The housing 12 is heated by the mandrel during this flange forming process to soften the housing plastic material to its deformable plastic state to allow the material to fold over and onto the ferrule base portion. The ferrule 14 is now securely located within housing 12 between top annular flange 18 and annular edge 16, as shown in FIG. 7.

Figure 9:
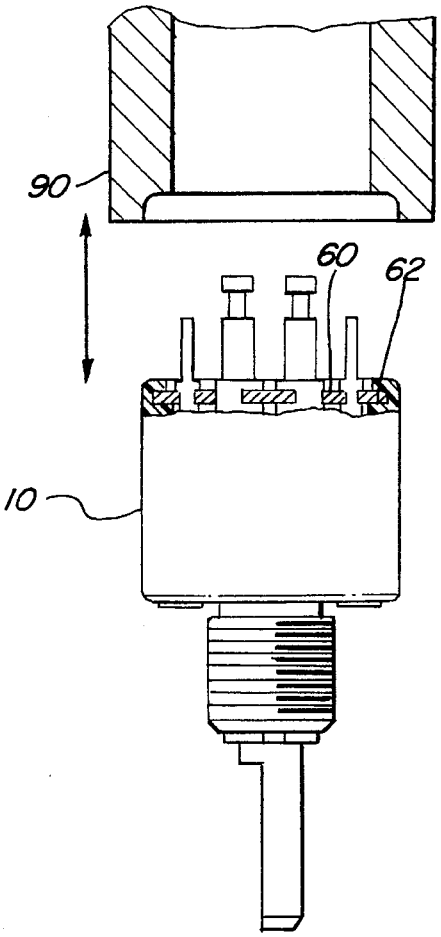
Figure 11:
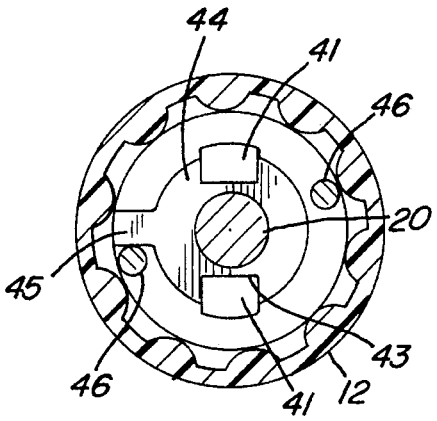
FIG. 11 is a cross-sectional view of the switch assembly taken along line 11—11 of FIG. 8.

The interior parts (rotor assembly) of the switch 10 are assembled and located within the housing 12, such as shaft 20 and rotor 40 with springs 48, 72, detent balls 50, 72, and brush contacts 74, O-ring 24, stop 46 and C-clip 22 as shown in FIG. 8. Stator 60 is next inserted into the other end of housing 12 and seated on opposed inner annular edge or shoulder 62 with the bottom end portion of the housing extending above the stator plate 61. The bottom end portion is then rolled toward the center portion and over the stator by the heated mandrel 90 pressing onto the end of the housing as shown in FIG. 9. During this forming process the housing is again heated by the mandrel 90 to the same temperature range discussed above with respect to the ferrule securing step. The heat softens the plastic material to facilitate the remolding process of the housing.

Switch 10 is thus fabricated using a minimum number of steps. The bottom end of the switch may be sealed by applying a layer of epoxy or other sealant over the outer area of the stator. External contaminants thus will be inhibited from entering the internal area of switch 10. Features of the invention may be used in switches of various sizes with different numbers of stator contacts and contact configurations and arrangements.

The switch and method of assembling the same described above has resulted in lowering the manufacturing costs by about 30%–40% as compared with comparable prior art switches employing a one-piece metal housing and ferrule.

The above-described detailed description of a preferred embodiment described the best mode contemplated by the inventors for carrying out the present invention at the time this application was filed and is offered by way of example and not by way of limitation. Accordingly, various modifications may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. A rotary switch, comprising:

a tubular housing having a cylindrically shaped body with opposed inwardly extending shoulders at opposite ends thereof;

a ferrule having a cylindrical base portion seated on one shoulder of the housing, the housing forming a first integral flange extending over the cylindrical base portion of the ferrule to hold the ferrule securely against the shoulder and within the housing;

a shaft rotatably mounted in the ferrule;

a rotor assembly disposed within the housing and coupled to the shaft, the rotor assembly carrying at least one rotor contact; and a stator seated on the other shoulder of the housing, the housing forming a second integral flange extending over the stator to hold the stator securely against said other shoulder and within the housing, the stator carrying at least one stator contact for selectively engaging the rotor contact.

2. The switch defined in claim 1 wherein the opposed shoulders annularly circumscribe the inner cylindrical wall of the tubular housing.

3. The switch defined in claim 2 wherein the ferrule and housing have cooperative key means to lock the ferrule and housing in fixed relationship.

4. The switch defined in claim 1 wherein the stator and housing have cooperative key means to lock the stator and housing in fixed relationship.

5. The switch defined in claim 1 wherein the ferrule includes a threaded cylindrical portion of smaller diameter than the base portion, the threaded portion extending outwardly from the housing and further comprising an annular panel seal disposed over the threaded portion of the ferrule and engaging one face of the base portion thereof.

6. In a rotary switch in which a contact bearing rotor assembly and a contact bearing stator are disposed in a tubular housing with a ferrule extending outwardly of the housing at one end and a shaft extending through the ferrule and connected to the rotor assembly for providing rotary motion thereto the improvement, comprising:

the housing being formed of a thermoplastic material and having opposed ends and a seating structure near one of the opposed ends;

the ferrule being formed with a base portion, the base portion being seated on the seating structure within the housing and held therein by an inwardly extending flange of the housing at said one opposed end.

7. The invention of claim 6 wherein the housing forms an inner annular edge near the one opposed end, the ferrule base portion being seated upon this inner annular edge.

8. The invention of claim 6 wherein the stator is formed with a plate portion, the housing having another seating structure near the other opposed end, the plate portion of the stator being seated within the housing on said other seating structure and held therein by a flange of the housing at the other opposed end.

9. The invention of claim 8 wherein the other seating structure is an inner annular edge near the other opposed end of the housing, the stator plate portion seated upon this opposed end inner annular edge.

10. The invention of claim 6 wherein the ferrule and housing have cooperative notches and tabs which locate together to prevent rotation of the ferrule in the housing.

11. The invention of claim 5 wherein the stator carries at least one common contact and a plurality of terminal contacts and wherein said at least one rotor contact is arranged to selectively connect the stator common contact with a stator terminal contact.

12. A rotary switch comprising:

a tubular housing with opposed inwardly extending shoulders at opposite ends thereof;

a rotor assembly carrying at least one rotor contact disposed within the housing;

a ferrule having an elongated hollow tubular portion and a cylindrical base portion, the base portion being seated on one shoulder of the housing with the tubular portion extending outwardly from the housing, the housing forming a first integral flange extending over the outer periphery of the base portion of the ferrule to hold the ferrule securely in place against the shoulder and within the housing;

a disc-shaped stator seated on the other shoulder of the housing, the housing forming a second integral flange extending over the stator to hold the stator securely against the other shoulder and within the housing, the stator carrying at least two contacts extending therethrough, each of the contacts having an inner end for selective engagement with the rotor contact and an outer terminal end for receiving an electrically conducting wire; and a shaft rotatably mounted in the ferrule and connected to the rotor, the shaft extending outwardly of the ferrule to allow an operator to rotate the shaft and rotor assembly.

13. The rotary switch of claim 12 wherein the ferrule and housing have cooperative notches and tabs which locate together to prevent rotation of the ferrule within the housing.

14. The rotary switch of claim 13 wherein the housing is formed of a thermoplastic material.

* * * * *